US011673393B1

(12) United States Patent
Sambhy et al.

(10) Patent No.: US 11,673,393 B1
(45) Date of Patent: Jun. 13, 2023

(54) SYSTEM AND METHOD FOR PRESERVING INK VISCOSITY IN INKJETS IN AN INKJET PRINTER DURING PRINTING

(71) Applicant: Xerox Corporation, Norwalk, CT (US)

(72) Inventors: Varun Sambhy, Pittsford, NY (US); Seemit Praharaj, Webster, NY (US); Douglas K. Herrmann, Webster, NY (US); Jason M. LeFevre, Penfield, NY (US); Chu-Heng Liu, Penfield, NY (US); Linn C. Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 17/455,231

(22) Filed: Nov. 17, 2021

(51) Int. Cl.
*B41J 2/165* (2006.01)
*B41J 2/175* (2006.01)

(52) U.S. Cl.
CPC ..... *B41J 2/165* (2013.01); *B41J 2/17503* (2013.01); *B41J 2002/16502* (2013.01)

(58) Field of Classification Search
CPC ..... B41J 2/165
See application file for complete search history.

(56) References Cited

U.S. PATENT DOCUMENTS

| | | | | |
|---|---|---|---|---|
| 7,571,996 | B2 | 8/2009 | Domoto et al. | |
| 2010/0085399 | A1* | 4/2010 | O'Neal | B41J 2/16585 347/31 |
| 2010/0085400 | A1* | 4/2010 | O'Neal | B41J 2/16585 347/31 |
| 2014/0168313 | A1 | 6/2014 | Ramesh et al. | |
| 2021/0187948 | A1 | 6/2021 | Praharaj et al. | |
| 2021/0187953 | A1 | 6/2021 | Liu et al. | |

* cited by examiner

*Primary Examiner* — Sharon Polk
(74) *Attorney, Agent, or Firm* — Maginot Moore & Beck LLP

(57) ABSTRACT

A method of operating a printer supplies an ink solvent or mixture of ink solvents to porous members positioned adjacent printheads. The ink solvent or solvent mixture evaporates from the porous members to provide a solvent vapor environment in the vicinity of the nozzle plates of the printheads. The solvent vapor environment attenuates the evaporation of ink solvent from ink drops on the nozzle plates or from the ink in the nozzles of the printheads. Thus, the ink on the nozzle plates and in the nozzles does not dry out and the operational status of the inkjets is preserved.

18 Claims, 6 Drawing Sheets

SYSTEM AND METHOD FOR PRESERVING INK VISCOSITY IN INKJETS IN AN INKJET PRINTER DURING PRINTING

TECHNICAL FIELD

This disclosure relates generally to devices that produce ink images on media, and more particularly, to the preservation of ink viscosity in inkjets in such devices during printing.

BACKGROUND

Inkjet imaging devices, also known as inkjet printers, eject liquid ink from printheads to form images on an image receiving surface. The printheads include a plurality of inkjets that are arranged in an array. Each inkjet has a thermal or piezoelectric actuator that is coupled to a printhead controller. The printhead controller generates firing signals that correspond to digital data content corresponding to images. The actuators in the printheads respond to the firing signals by expanding into an ink chamber to eject ink drops onto an image receiving surface and form an ink image that corresponds to the digital image content used to generate the firing signals. The image receiving surface is usually a continuous web of media material or a series of media sheets.

Inkjet printers used for producing color images typically include multiple printhead assemblies. Each printhead assembly includes one or more printheads that typically eject a single color of ink. In a typical inkjet color printer, four printhead assemblies are positioned in a process direction with each printhead assembly ejecting a different color of ink. The four ink colors most frequently used are cyan, magenta, yellow, and black. The common nomenclature for such printers is CMYK color printers. Some CMYK printers have two printhead assemblies that print each color of ink. The printhead assemblies that print the same color of ink are offset from each other by one-half of the distance between adjacent inkjets in the cross-process direction to double the number of pixels per inch density of a line of the color of ink ejected by the printheads in the two assemblies. As used in this document, the term "process direction" means the direction of movement of the image receiving surface as it passes the printheads in the printer and the term "cross-process direction" means a direction that is perpendicular to the process direction in the plane of the image receiving surface.

Image quality in color inkjet printers depends upon at least three parameters: color gamut, graininess, and ink drop satellites. Color gamut can be addressed by using inks that dry faster. The faster drying inks allow more ink to be deposited in the image. The dryers also evaporate the ink more quickly so more ink volume can be dispensed on the media without the ink offsetting to rollers moving the media through the printer.

Graininess, and more specifically overlay graininess, can also be addressed by faster drying inks because the ink drops adhere to the media more quickly so they are immobilized faster. The primary cause of overlay graininess is shear force acting on the ink drops, which increases wet-drop-on-wet-drop interaction that intermixes the ink drops with one another. Thus, decreased mobilization reduces the ink drop interaction and, consequently, overlay graininess.

While faster drying inks improve color gamut and reduce overlay graininess, they also lead to faster ink drying on the nozzle plate and in the nozzles, especially if the inkjets are not operated frequently enough to prevent the ink in the nozzles from drying. Dry ink on the nozzle plate and in the nozzles leads to inoperative inkjets. As used in this document, the term "inoperative inkjet" means inkjets that do not eject ink drops at all or inkjets that eject ink drops in a direction away from the normal between an inkjet nozzle and the ink receiving surface. This problem occurs with fast drying inks more frequently in low ink coverage areas during long run prints. Low ink coverage areas occur where some inkjets are not used for a relatively long period of time so the ink in these nozzles are more prone to dry in the nozzles. Users of color inkjet printers do not accept high rates of inoperative inkjets resulting from low ink coverage areas in long print runs. Preserving the viscosity of quick drying inks in inkjet nozzles, particularly in inkjet nozzles positioned in low ink coverage areas, would be beneficial.

SUMMARY

A color inkjet printer is configured to attenuate the drying of inks, especially fast drying inks, in the nozzles of inkjets in the printheads of the printer. The color inkjet printer includes a plurality of printheads, a first plurality of porous members, the porous members in the first plurality of porous members being positioned adjacent to two or more different printheads in the plurality of printheads, and a reservoir configured to hold a volume of a fluid, the reservoir being fluidly connected to each porous member to provide fluid from the reservoir to each porous member.

A method of operating a color inkjet printer attenuates the drying of inks, especially fast drying inks, in the nozzles of inkjets in the printheads of the printer. The method includes positioning a first plurality of porous members adjacent to two or more different printheads in a plurality of printheads, and providing fluid from a reservoir to each porous member.

BRIEF DESCRIPTION OF THE DRAWINGS

The foregoing aspects and other features of a color inkjet printer and color inkjet printer operational method that attenuates the drying of inks, especially fast drying inks, in the nozzles of inkjets in the printheads of the printer are explained in the following description, taken in connection with the accompanying drawings.

DETAILED DESCRIPTION

Figure 1:
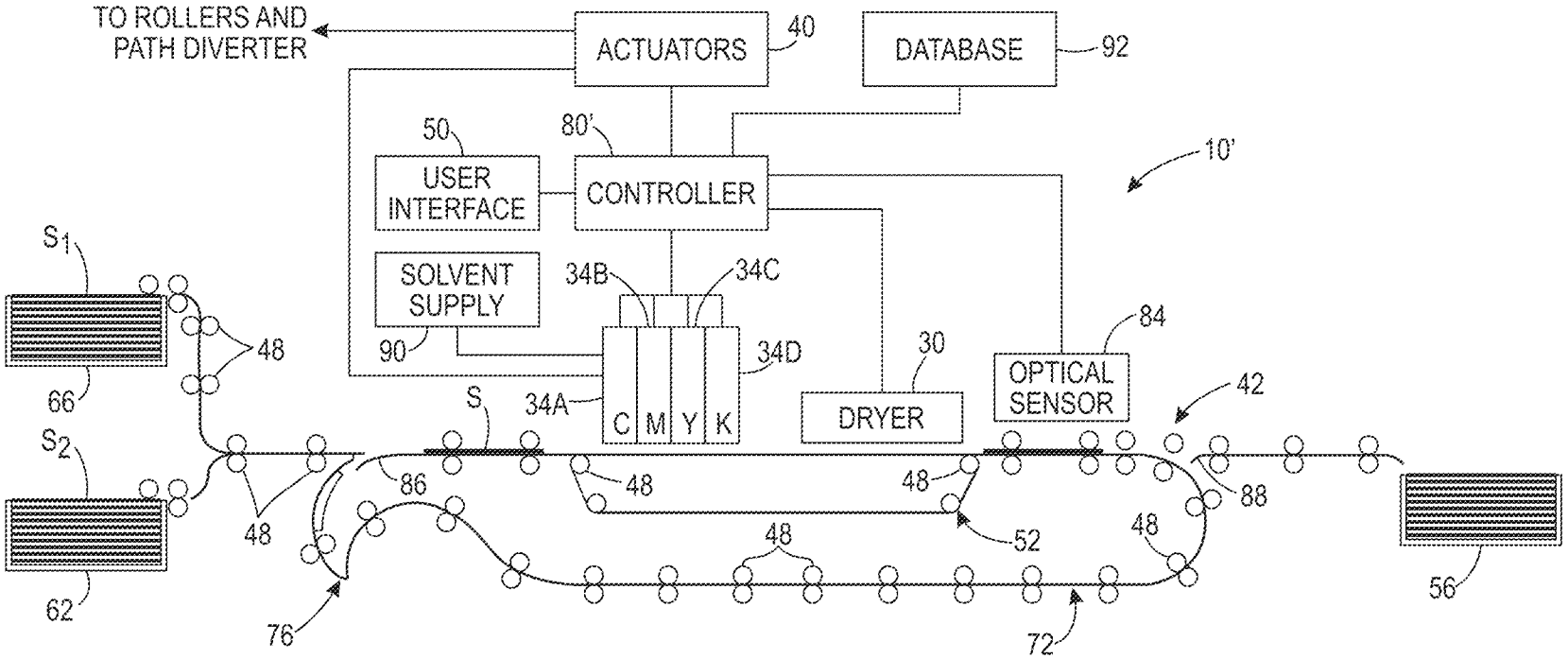
FIG. 1 is a schematic drawing of a color inkjet printer that reduces the likelihood of ink drying in the inkjets of the printheads.

For a general understanding of the environment for the printer and the printer operational method disclosed herein as well as the details for the printer and the printer operational method, reference is made to the drawings. In the drawings, like reference numerals have been used throughout to designate like elements. As used herein, the word "printer" encompasses any apparatus that ejects ink drops onto different types of media to form ink images.

The printer and method described below uses a solvent laden fibrous material to humidify the print zone of a printer with a solvent vapor to prevent or slow the drying of ink on the printhead nozzle plate or in the inkjet nozzles. The solvent vapor has been shown to improve the reliability of the printhead inkjets by reducing the number of inoperative inkjets that occur in the printheads used to print low ink coverage areas even when fast drying inks are used in the printheads.

Figure 4:
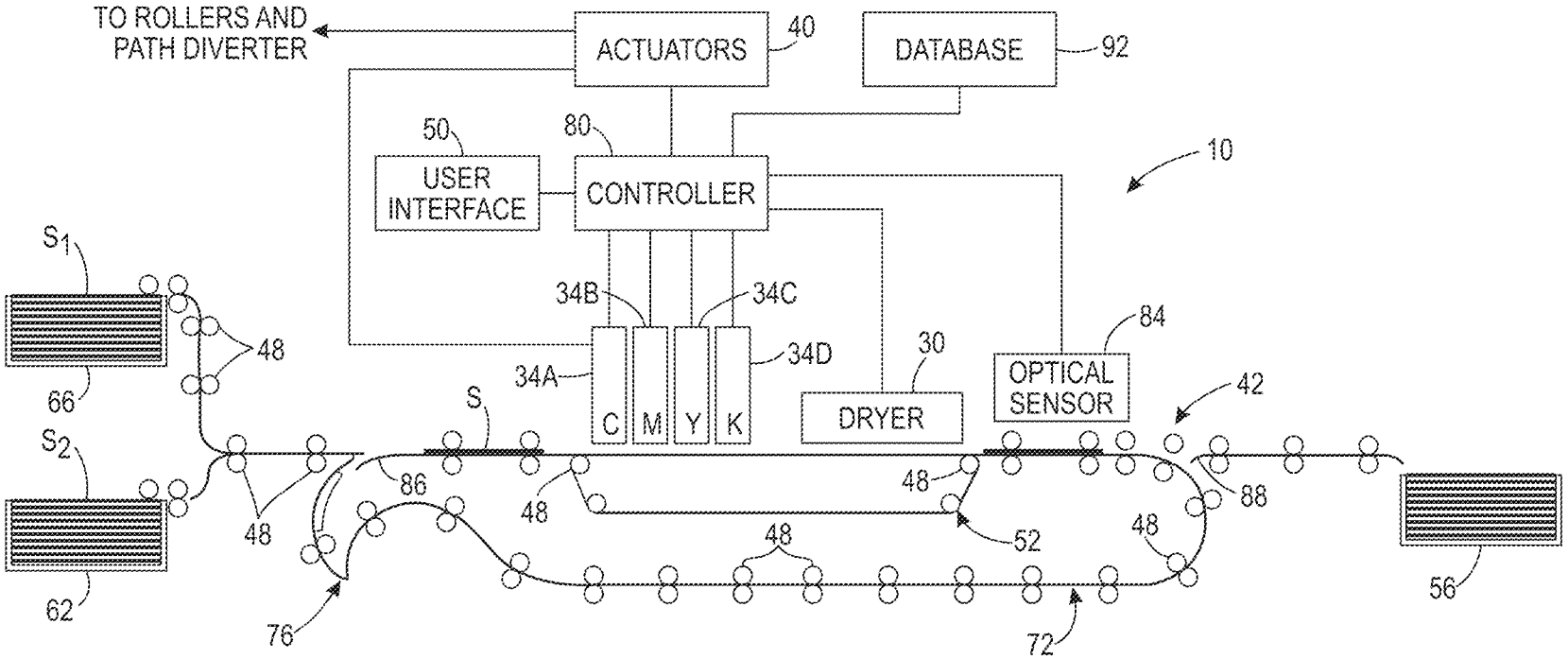
FIG. 4 PRIOR ART
FIG. 4 is a schematic drawing of a prior art color inkjet printer in which image quality is adversely impacted by the use of faster drying inks.

FIG. 4 depicts a prior art high-speed color inkjet printer 10 that does not reduce the likelihood of fast drying inks losing their viscosity in inkjets used to print low ink coverage areas during long print runs. As illustrated, the printer 10 is a printer that directly forms an ink image on a surface of a media sheet stripped from one of the supplies of media sheets $S_1$ or $S_2$ and the sheets S are moved through the printer 10 by the controller 80 operating one or more of the actuators 40 that are operatively connected to rollers or to at least one driving roller of conveyor 52 that comprise a portion of the media transport 42 that passes through the print zone PZ (shown in FIG. 5) of the printer. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads within a module or between modules can also be interlaced so the density of the drops ejected by the printheads in the cross-process direction can be greater than the smallest spacing between the inkjets in a printhead in the cross-process direction. Although printer 10 is depicted with only two supplies of media sheets, the printer can be configured with three or more sheet supplies, each containing a different type or size of media.

Figure 5:
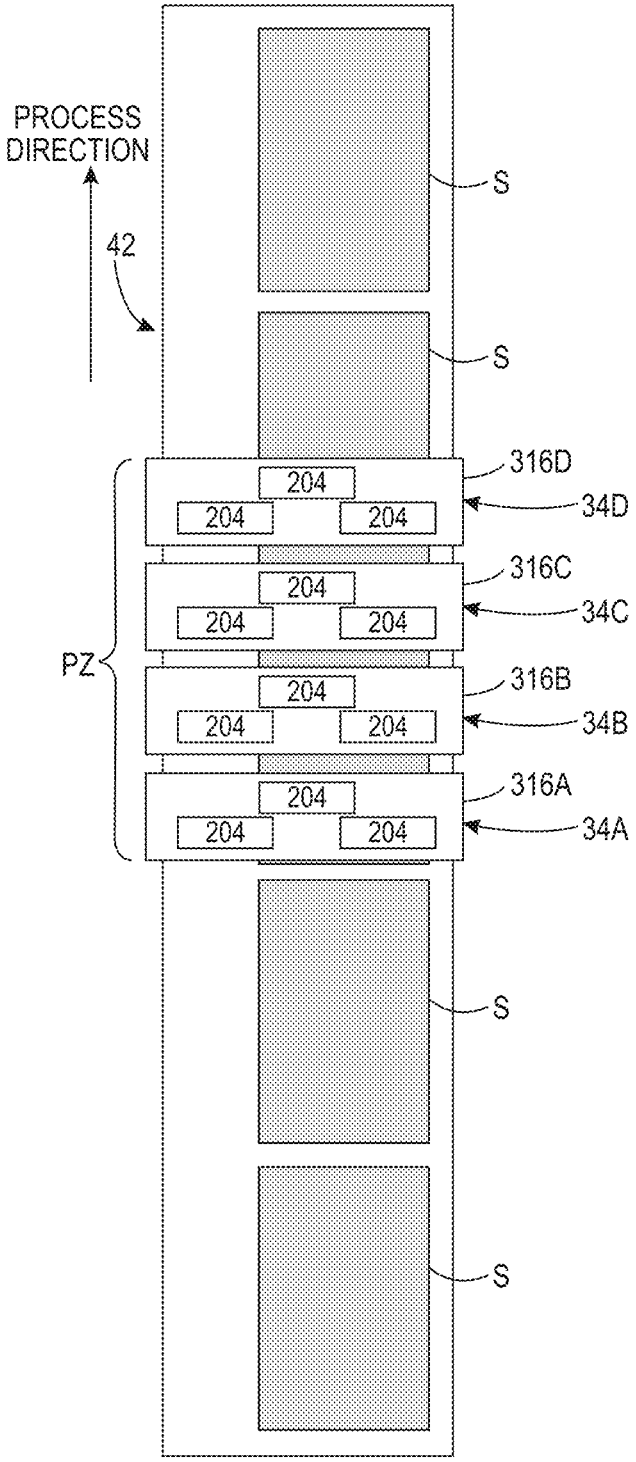
FIG. 5 PRIOR ART
FIG. 5 depicts the print zone in the printer of FIG. 4.

The print zone PZ in the prior art printer 10 of FIG. 4 is shown in FIG. 5. The print zone PZ has a length in the process direction commensurate with the distance from the first inkjets that a sheet passes in the process direction to the last inkjets that a sheet passes in the process direction and it has a width that is the maximum distance between the most outboard inkjets on opposite sides of the print zone that are directly across from one another in the cross-process direction. Each printhead module 34A, 34B, 34C, and 34D shown in FIG. 5 has three printheads 204 mounted to one of the printhead carrier plates 316A, 316B, 316C, and 316D, respectively.

As shown in FIG. 4, the printed image passes under an image dryer 30 after the ink image is printed on a sheet S. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air using a fan or other pressurized source of air over the ink to supplement the evaporation of the water or solvent from the ink. The air is then collected and evacuated by air returns to reduce the interference of the dryer air flow with other components in the printer.

Figure 3:
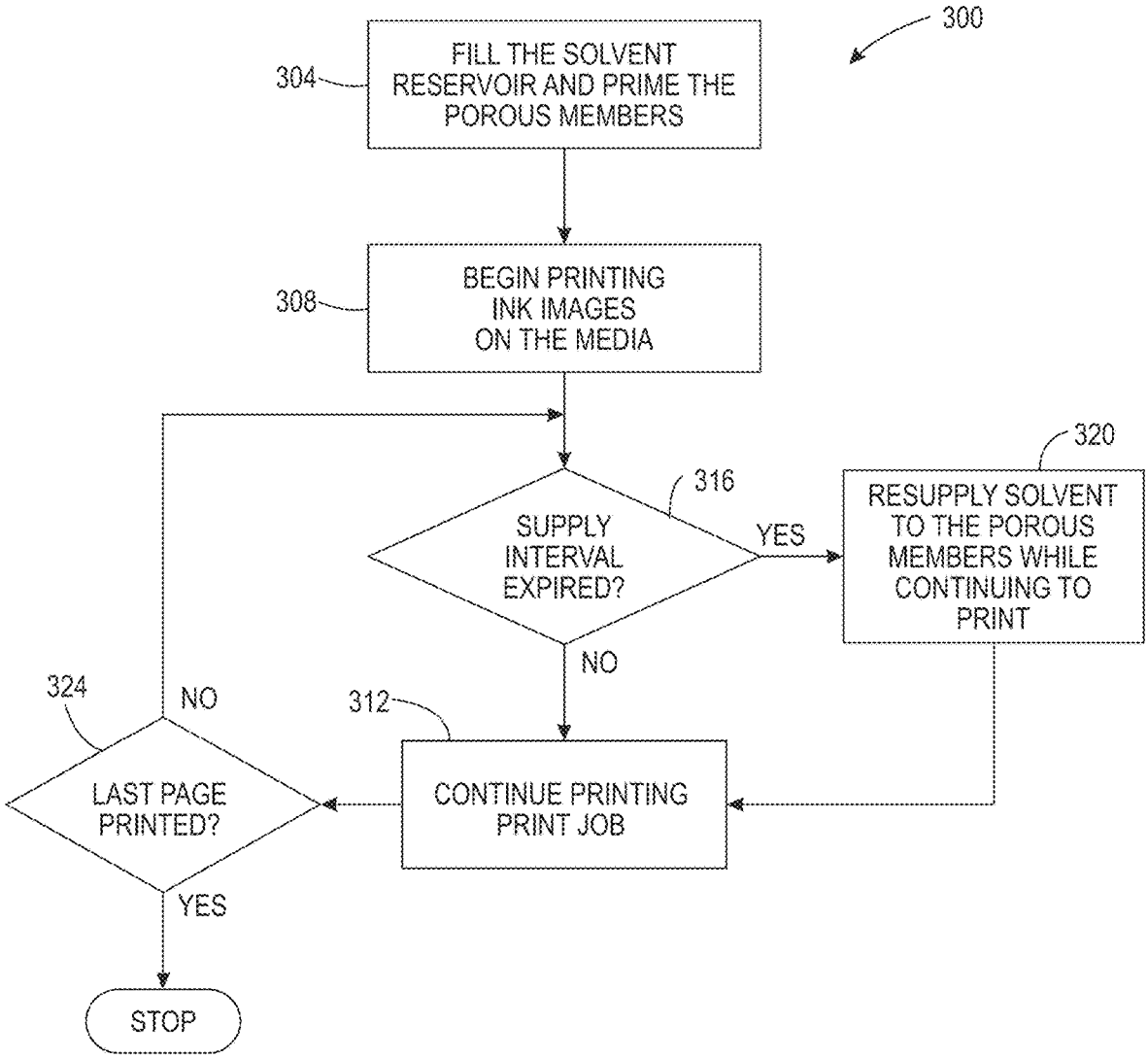
FIG. 3 is a flow diagram of a process for operating the printer of FIG. 1 so the likelihood of ink drying in the inkjets of the printheads in the printer is reduced.

A duplex path 72 is provided to receive a sheet from the transport system 42 after a substrate has been printed and move it by the rotation of rollers in an opposite direction to the direction of movement past the printheads. At position 76 in the duplex path 72, the substrate can be turned over so it can merge into the job stream being carried by the media transport system 42. The controller 80 is configured to flip the sheet selectively. That is, the controller 80 can operate actuators to turn the sheet over so the reverse side of the sheet can be printed or it can operate actuators so the sheet is returned to the transport path without turning over the sheet so the printed side of the sheet can be printed again. Movement of pivoting member 88 provides access to the duplex path 72. Rotation of pivoting member 88 is controlled by controller 80 selectively operating an actuator 40 operatively connected to the pivoting member 88. When pivoting member 88 is rotated counterclockwise as shown in FIG. 3, a substrate from media transport 42 is diverted to the duplex path 72. Rotating the pivoting member 88 in the clockwise direction from the diverting position closes access to the duplex path 72 so substrates on the media transport move to the receptacle 56. Another pivoting member 86 is positioned between position 76 in the duplex path 72 and the media transport 42. When controller 80 operates an actuator to rotate pivoting member 86 in the counterclockwise direction, a substrate from the duplex path 72 merges into the job stream on media transport 42. Rotating the pivoting member 86 in the clockwise direction closes the duplex path access to the media transport 42.

As further shown in FIG. 4, the printed media sheets S not diverted to the duplex path 72 are carried by the media transport to the sheet receptacle 56 in which they are be collected. Before the printed sheets reach the receptacle 56, they pass by an optical sensor 84. The optical sensor 84 generates image data of the printed sheets and this image data is analyzed by the controller 80. The controller 80 is configured to detect streakiness in the printed images on the media sheets of a print job. Additionally, sheets that are printed with test pattern images are inserted at intervals during the print job. These test pattern images are analyzed by the controller 80 to determine which inkjets, if any, that were operated to eject ink into the test pattern did in fact do so, and if an inkjet did eject an ink drop whether the drop landed at its intended position with an appropriate mass. Any inkjet not ejecting an ink drop it was supposed to eject or ejecting a drop not having the right mass or landing at an errant position is called an inoperative inkjet in this document. The controller can store data identifying the inoperative inkjets in database 92 operatively connected to the controller. These sheets printed with the test patterns are sometimes called run-time missing inkjet (RTMJ) sheets and these sheets are discarded from the output of the print job. A user can operate the user interface 50 to obtain reports displayed on the interface that identify the number of inoperative inkjets and the printheads in which the inoperative inkjets are located. The optical sensor can be a digital camera, an array of LEDs and photodetectors, or other devices configured to generate image data of a passing surface. As already noted, the media transport also includes a duplex path that can turn a sheet over and return it to the transport prior to the printhead modules so the opposite side of the sheet can be printed. While FIG. 4 shows the printed sheets as being collected in the sheet receptacle, they can be directed to other processing stations (not shown) that perform tasks such as folding, collating, binding, and stapling of the media sheets.

Operation and control of the various subsystems, components and functions of the machine or printer 10 are performed with the aid of a controller or electronic subsystem (ESS) 80. The ESS or controller 80 is operatively connected to the components of the printhead modules 34A-34D (and thus the printheads), the actuators 40, and the dryer 30. The ESS or controller 80, for example, is a self-contained computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares, and manages the image data flow between image input sources, such as a scanning system or an online or a work station connection (not shown), and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image content data for an image to be produced are sent to the controller 80 from either a scanning system or an online or work station connection for processing and generation of the printhead control signals output to the printhead modules 34A-34D. Along with the image content data, the controller receives print job parameters that identify the media weight, media dimensions, print speed, media type, ink area coverage to be produced on each side of each sheet, location of the image to be produced on each side of each sheet, media color, media fiber orientation for fibrous media, print zone temperature and humidity, media moisture content, and media manufacturer. As used in this document, the term "print job parameters" means non-image content data for a print job and the term "image content data" means digital data that identifies an ink image to be printed on a media sheet.

Using like reference numbers to identify like components, FIG. 1 depicts a high-speed color inkjet printer 10' in which a solvent supply system 90 is used to maintain the viscosity of ink on nozzle plates and in the nozzles of inkjets. The system 90 is depicted as being connected to the printhead module 34A only in order to simplify the figure. As described in more detail below, the system 90 is fluidly connected to porous members positioned on either side of the printheads in the printhead modules 34A, 34B, 34C, and 34D in the process direction.

Figure 2A:
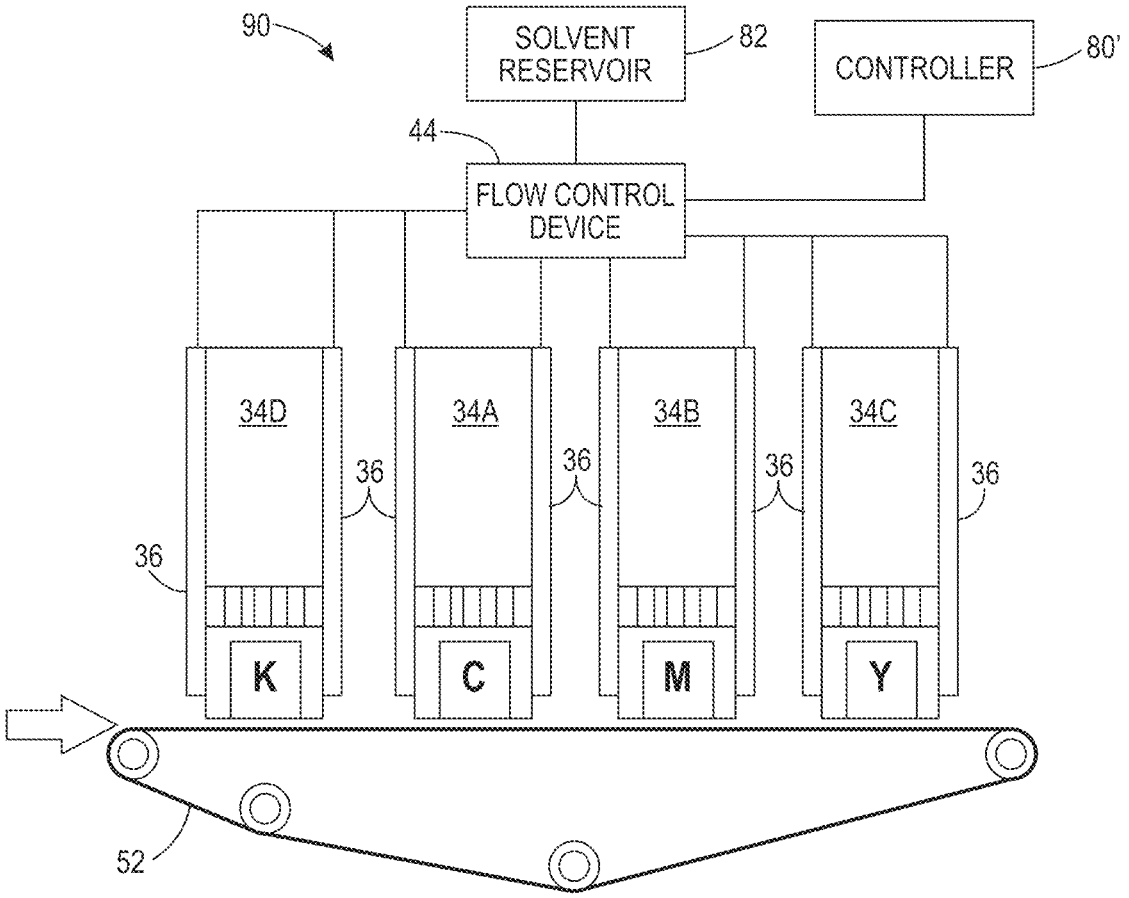
FIG. 2A is a block diagram of a solvent supply system used in the printer of FIG. 1 to reduce the likelihood of ink drying in the inkjets of the printheads in the printer.
Figure 2B:
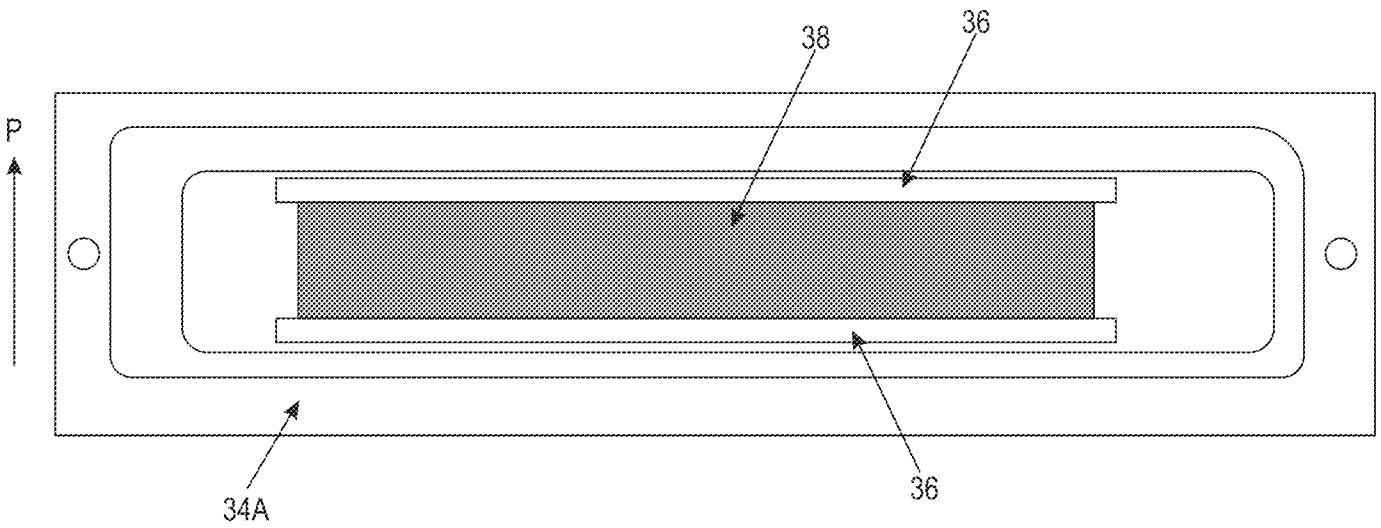
FIG. 2B is a bottom view of one printhead in one of the printhead modules of the printer shown in FIG. 1 that depicts the locations of the porous members on either side of the printhead.

The solvent supply system 90 is shown in more detail in FIG. 2A and FIG. 2B. In FIG. 2A, the system 90 includes a solvent reservoir 82, a flow control device 44, and porous members 36. The solvent reservoir 82 is a vessel having an internal volume configured to hold an ink solvent or a mixture of ink solvents. The ink solvents can include, but are not limited to, water, hexanediol, butanediol, and propanediol, which are ink solvents commonly used in aqueous inkjet printers. In embodiments in which inks having different solvents are used, the fluid in the reservoir is a mixture of the various solvents in some appropriate ratio. In one embodiment, the ratio of the different solvents is 1:1:1. The flow control device 44 in one embodiment is a pump. The pump is interposed between the solvent reservoir 82 and the conduits leading to the porous members 36. The controller 80' is operatively connected to the pump to operate it selectively and move solvent from the reservoir through the conduits to the porous members 36. In other embodiments, the reservoir 82 is positioned at a location that is at a higher gravitational potential than the printheads. In these embodiments, the flow control device 44 can be a valve or a drip mechanism. Again, the valve or drip mechanism is operatively connected to the controller 80' so the controller can operate the valve or drip mechanism to enable gravity to move fluid from the solvent reservoir 82 through the conduits to the porous members 36. One embodiment of a drip mechanism is a tube or pipe that has holes along its length at periodic intervals. For example, the drip mechanism can be a flexible tube made of elastomeric material with an internal diameter of about 6 mm and the holes have a diameter of about 0.25 to about 0.50 mm and are spaced from one another by an interval of about 4 mm to about 6 mm. This tube extends along at least one dimension of the porous members 36 so the solvent can seep from the holes in the tube and be absorbed by the porous members. The solvent eventually reaches the ends of the porous members 36 that are adjacent the printhead nozzle plates.

The porous members 36 are a configuration of a porous material positioned on opposite sides of the printheads in the printhead modules 34A, 34B, 34C, and 34D in the process direction P. Only one printhead of module 34A is shown in FIG. 2A to simplify the figure. In some embodiments, only one porous member is positioned on only one side of each printhead in a direction that is perpendicular to the process direction in the plane of the process direction. As used in this document, the term "porous member" means a configuration of material having internal cells that can hold fluid. Such material is commonly known as a "sponge." Such synthesized porous materials include, but are not limited to, polyester, polyurethane, vegetal cellulous, or the like. As shown in FIG. 2B, one end of each porous member 36 is flush with and adjacent to the nozzle plate 38 of the printhead about which the porous member is positioned. The other end of each porous member is connected to a conduit to receive solvent or a solvent mixture from the reservoir 82. The solvent or solvent mixture is absorbed by the porous member and distributed through its volume. As the solvent or solvent mixture evaporates from the porous member, the solvent vapor permeates the print zone. This solvent vapor prevents or attenuates the evaporation of solvent from the ink on the nozzle plates of the printheads or the ink in nozzles of the printheads. Thus, the ink does not dry and produce inoperative inkjets, especially when the inks are fast drying or the inkjets are used to print low coverage areas in long print runs.

The solvent supply system 90 described above produces a solvent vapor environment around the printhead nozzle plate to prevent or slow the drying of ink on the printhead nozzle plate. The solvent or solvent mixture evaporates and diffuses from the porous members into the environment around the nozzle plates. This vapor increases the partial vapor pressure of the solvent around the nozzle plate. The increased solvent vapor pressure around the nozzle plate slows down the evaporation of the ink in the printhead nozzles and reduces the likelihood of inoperative inkjets occurring. The solvent in the porous members is replenished by solvent supplied from a reservoir through the controller operating a flow control device to either pump solvent from the reservoir to the porous members or to enable gravity to urge solvent from the reservoir to the porous members.

FIG. 3 depicts a flow diagram for a process 300 that operates the solvent supply system 90 in the printer 10' to maintain a solvent vapor environment in the print zone of the printer. In the discussion below, a reference to the process 300 performing a function or action refers to the operation of a controller, such as controller 80', to execute stored program instructions to perform the function or action in association with other components in the printer. The process 300 is described as being performed with the printer 10' of FIG. 1 for illustrative purposes.

The process 300 of operating the printer 10' begins with the filling of the reservoir with a solvent or a solvent mixture and the operation of the flow control device to prime the porous members with the solvent or the solvent mixture (block 304). The process begins printing of the media (block 308). Upon detection of the expiration of a predetermined period of time (block 316), the process continues printing the media while the flow control device is operated to resupply the solvent or the solvent mixture to the porous members (block 320). Printing continues (block 312) with occasional resupply of the solvent or solvent mixture to the porous members (blocks 316 and 320) until the last sheet is printed (block 324). At that point, the process is finished.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

a plurality of printheads;

a first plurality of porous members, the porous members in the first plurality of porous members being positioned adjacent to two or more different printheads in the plurality of printheads;

a reservoir configured to hold a volume of a fluid, the reservoir being fluidly connected to each porous member to provide fluid from the reservoir to each porous member;

a flow control device interposed between the reservoir and each porous member; and a controller operatively connected to the flow control device, the controller being configured to:

operate the flow control device selectively to provide the fluid from the reservoir to the porous members.

2. The inkjet printer of claim 1, the controller being further configured to:

operate the flow control device at an expiration of a predetermined time interval.

3. The inkjet printer of claim 1 wherein the flow control device is a pump.

4. The inkjet printer of claim 1 wherein the flow control device is one of a valve and a drip mechanism.

5. The inkjet printer of claim 4, the drip mechanism further comprising:

a tube having a wall that surrounds a conduit, the wall of the tube having perforations that extend from an outside surface of the wall to the conduit within the tube.

6. The inkjet printer of claim 5 wherein the tube consists essentially of elastomeric material with the conduit having an internal diameter of about 6 mm and the perforations in the wall having a diameter in a range of about 0.25 to about 0.50 mm and the holes are spaced from one another by an interval of about 4 mm to about 6 mm.

7. The inkjet printer of claim 1 wherein the porous members are comprised essentially of polyester, polyurethane, or vegetal cellulose.

8. The inkjet printer of claim 1 wherein each porous member in the first plurality of porous members is positioned adjacent to a different printhead in the plurality of printheads in a one-to-one correspondence.

9. The inkjet printer of claim 8 further comprising:

a second plurality of porous members, the porous members in the second plurality of porous members being positioned on a side of each printhead that is opposite the porous member in the first plurality of porous members adjacent to the printhead in a process direction.

10. A method for operating an inkjet printer comprising:

positioning a first plurality of porous members adjacent to two or more different printheads in a plurality of printheads;

providing fluid from a reservoir to each porous member; and operating a flow control device interposed between the reservoir and each porous member selectively to provide the fluid from the reservoir to the porous members.

11. The method of claim 10, the operation of the flow control device further comprising:

operating the flow control device at an expiration of a predetermined time interval.

12. The method of claim 10, the operation of the flow control device further comprising:

operating a pump.

13. The method of claim 10, the operation of the flow control device further comprising:

operating one of a valve and a drip mechanism.

14. The method of claim 13, the operation of the drip mechanism further comprising:

connecting one end of a tube having a wall that surrounds a conduit to the fluid reservoir; and positioning the tube along one dimension of at least one porous member so perforations in the wall of the tube enable fluid to flow from the conduit to an outside surface of the wall to the at least one porous member.

15. The method of claim 14 wherein the positioning of the tube further comprising:

positioning an elastomeric material surrounding the conduit and the perforations in the wall having a diameter in a range of about 0.25 to about 0.50 mm.

16. The method of claim 10, the positioning of the porous members further comprising:

positioning porous members comprised essentially of polyester, polyurethane, or vegetal cellulose.

17. The method of claim 10, the positioning of the porous members further comprising:

positioning the porous members adjacent to different printheads in the plurality of printheads in a one-to-one correspondence.

18. The method of claim 17 further comprising:

positioning each porous member in a second plurality of porous members on a side of each printhead that is opposite the porous member in the first plurality of porous members adjacent to the printhead in a process direction.

* * * * *